US006453623B1

(12) United States Patent
Nelson et al.

(10) Patent No.: US 6,453,623 B1
(45) Date of Patent: Sep. 24, 2002

(54) ROOF SNOW BARRIER

(75) Inventors: Robin Nelson, Ottawa (CA); Jiri Krupka, Ottawa (CA); Steven Paul Guenette, Cumberland (CA); Dave Gerwing, Greely (CA); Colin Fabian, Ottawa (CA)

(73) Assignee: Roofers - Annex Inc. (CA)

( * ) Notice: Subject to any disclaimer, the term of this patent is extended or adjusted under 35 U.S.C. 154(b) by 0 days.

(21) Appl. No.: 09/490,119

(22) Filed: Jan. 24, 2000

(51) Int. Cl.[7] ..... E04D 13/00
(52) U.S. Cl. ..... 52/24; 52/25; 52/26; 411/432
(58) Field of Search ..... 52/24, 25, 26; 411/432

(56) References Cited

U.S. PATENT DOCUMENTS 5,609,326 A * 3/1997 Stearns et al. ..... 52/25
5,613,328 A * 3/1997 Alley ..... 52/25

* cited by examiner

*Primary Examiner*—Carl D. Friedman
*Assistant Examiner*—Chi Nguyen
(74) *Attorney, Agent, or Firm*—David J. French

(57) ABSTRACT

A snow barrier for a roof having modular components including brackets that slidingly interfit into rails that extend up and down the slope of the roof. The brackets may be rotated to provide fences of differing heights. A corrugated fence is easily installed by reason of a self-positioning, hooked, upper flange formed along the upper edge of the corrugated fence. The corrugated fence may be modular, being built-up of smaller, corrugated strips. Pads may replace the rails in supporting the brackets or the brackets may be fastened directly to the roof.

14 Claims, 4 Drawing Sheets

ROOF SNOW BARRIER

FIELD OF THE INVENTION

This invention relates to barriers for mounting along a roof to restrain snow and ice from sliding off the roof. More particularly, it relates to mechanical designs and methods of installation of such devices.

BACKGROUND TO THE INVENTION

Snow barriers are well established as a necessary accessory for roofs in northern climates. Such devices should be easy to install, anchor reliably, and be capable of retaining a substantial mass of snow. The design of such devices must address maximum, extreme conditions.

Typical prior art designs for snow barrier have employed tubing fitted through roof-mounted brackets. Such brackets have been individually mounted to the roof surface. Arrangements of this type are labourious to install and are difficult to align precisely.

A need exists for a more convenient methodology for installing snow barrier and associated hardware, that is of reasonable cost. The present invention addresses that objective.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to the invention in one aspect a snow barrier comprises a support bracket that slidably engages with a track. The track is mounted to the surface of a roof, preferably in the case of metal roofs, at a seam. Once the bracket has been slid to a correct location on the track, it is fastened in position and a fence installed, spanning between the brackets. As a track has a longer length than a bracket, it is easier to locate it over appropriate anchor points.

The brackets may have two legs, each with surfaces shaped to slidingly interfit within the track, but each leg having differing lengths. This provides the option of mounting the brackets to support fence attachments of differing heights and strengths on an upright leg of corresponding height.

A fence may be provided in the form of tubular rails that pass through the brackets. Preferably, the fence may be formed of corrugated sheet metal strips that are fastened to the up-slope face of the upright leg of the brackets. This corrugated sheet metal can be in a single sheet. Alternately, it may be modular in form, comprising lengths of single corrugations that are "U"-shaped in cross-section. These modular strips can be assembled to form a fence with multiple corrugations of selectable height and strengths.

The differing lengths of legs may be fitted with one, two or more corrugation elements.

Optionally, the brackets may also be perforated to receive and support tubular rails as well as being adapted to receive a corrugated fence. Such perforations may be along both legs of each bracket, inwardly from the outer edges of the legs of the brackets. The bracket legs may contain differing numbers of perforations along their respective legs to receive differing numbers of tubes. In this manner, a fence of differing heights and strengths may be installed.

An advantage of having the brackets installed to slide in tracks is that alignment is simplified. With a fence attached to the front face of the upright legs of two separated brackets, the remaining, intervening brackets may be slid up their respective tracks into position for attachment to the fence. Alignment is automatic.

The installation process is also enhanced by the feature of shaping the top edge of the corrugated fence with a hooked flange that will engage, and hook-over, the top end of a bracket. This ensures that the corrugated fence is in position at the correct height when it is attached. Attachment may be effected by any attachment means, such as screws. Each modular corrugation strip may also be provided with a reversely-bent bottom flange that will receive the hooked flange formed on the upper edge of a further corrugation strip positioned directly below.

As well as providing ease of alignment, the tracks may be dimensioned to extend both up-slope along the roof, above the fence line and down-slope. This allows the tracks to be preferably anchored to transverse stringers within the roof or other structural features of the roof that are not directly below the fence line. By extending the tracks up-roof, not only is the option of accessing a suitable anchor-point provided, but also, the lever-arm of the track in resisting the overturning of the fence by a heavy snow load is extended. This allows for a stronger construction and/or cost-saving adjustments in other components, such as the use of lower cost fasteners for attachment to the roof.

The features of the invention need not always incorporate a track mount. Optionally, brackets may be mounted directly on a roof, partially or entirely supported on pads of expanded width to distribute the forces applied to a roof when the snow barrier is placed under load.

By these features, and by the combination of these features a new and improved snow fence system can be provided.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
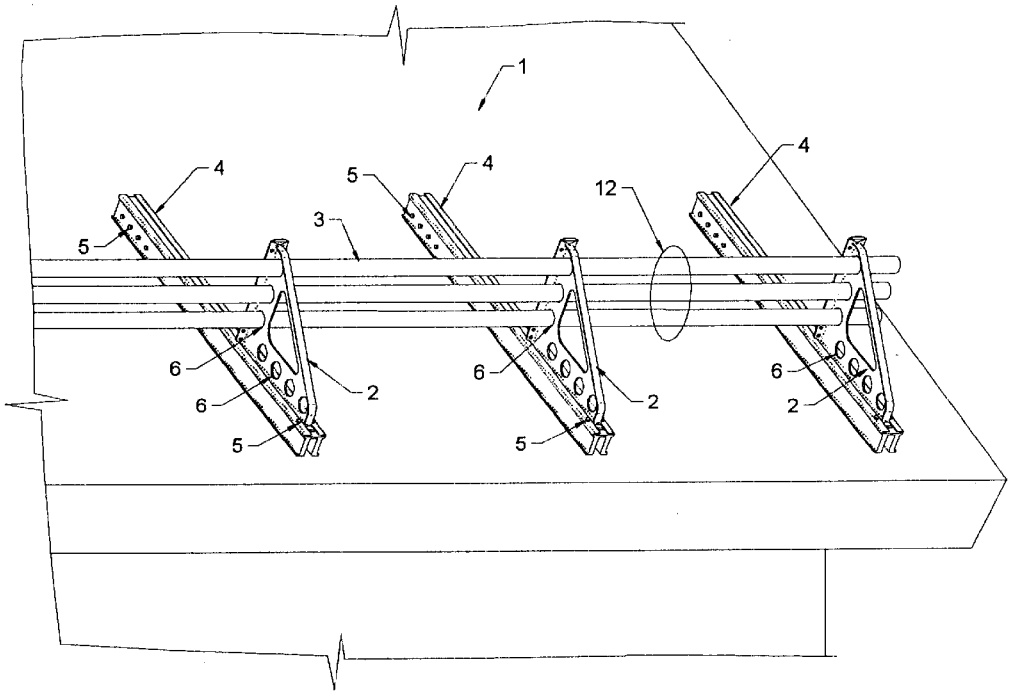
FIG. 1 is a perspective view of a snow barrier according to the invention mounted on tracks.

In FIG. 1 a roof 1 has a series of brackets 2 supporting tubes 3 to form a snow barrier comprising a fence 12. Each bracket 2 is slidingly seated in a track 4 and fastened in place on such track by attachment means 5, such as set screws 5. The tubes 3 pass through holes 6 in the brackets 2.

Figure 2:
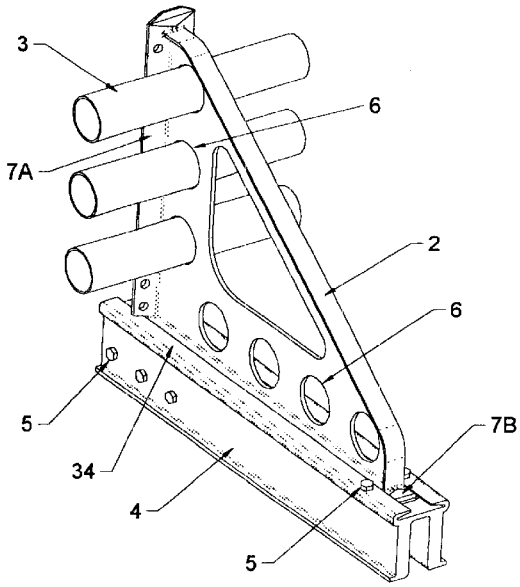
FIG. 2 is a detail perspective view of a bracket of FIG. 1 with a tubular fence installed.

As shown in FIG. 2, each bracket 2 has two legs 7A, 7B that may be reversed. Along one leg 7A as one version of the invention there are three holes 6; along the other leg 7B there are four holes 6. Alternate bracket formats may be provided with two and four holes 6. By rotating the bracket 2 through 90 degrees, a higher barrier of four tubes may be provided to serve as the fence 12.

As shown in FIG. 1, the tracks 4 preferably extend up-slope on the roof 1 to be anchored at a higher point, separated from the fence 12. This extended length anchors the snow barrier against being overturned by a load of snow.

Figure 3:
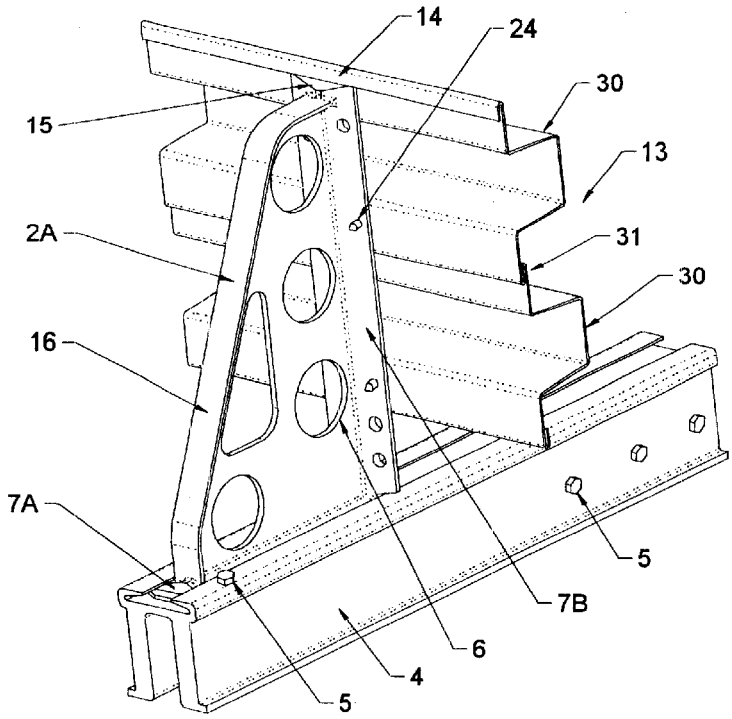
FIG. 3 is a perspective view of a bracket as in FIG. 2 with a corrugated fence installed.
Figure 4:
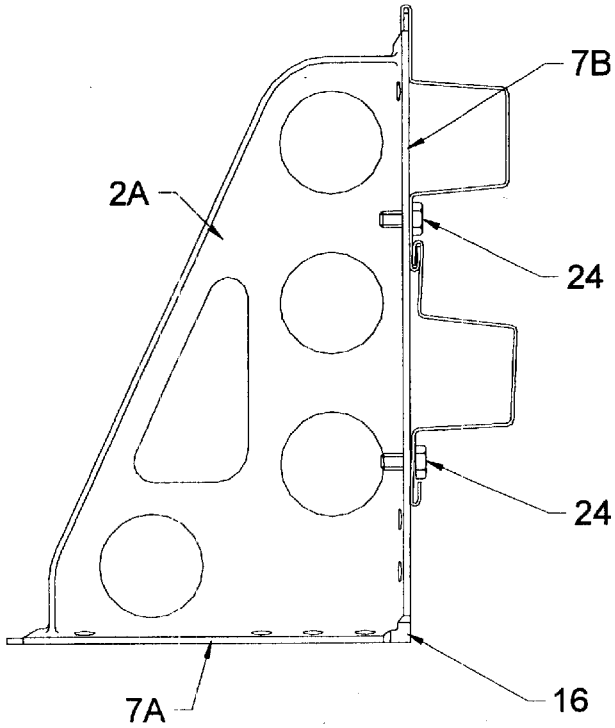
FIG. 4 is a side view of FIG. 3.

In FIG. 3 a corrugated fence 13 is shown. This fence 13 has two corrugated strips 30 that may be integrally or modularly formed. Each strip 30 has a "U"-shaped or "top-hat" cross-section. This specific shape is optional. The upper edge of a single corrugated strip 30 has a bent flange 14 to fit over the upper end 15 of the upright leg 7B of the bracket 2A. This helps align the corrugated fence 13 for attachment as by sheet metal screws 24 to the bracket 2A. The bracket 2A in this configuration has one leg 7A that is long enough to support a fence 13 with a single corrugation; and another leg 7B that can support a fence 13 with two corrugations.

Individual corrugated strips 30 may be coupled by interfitting lower bent flanges 31 of an upper strip 30 with the upper bent flanges 14 of a lower strip 30.

Figure 5:
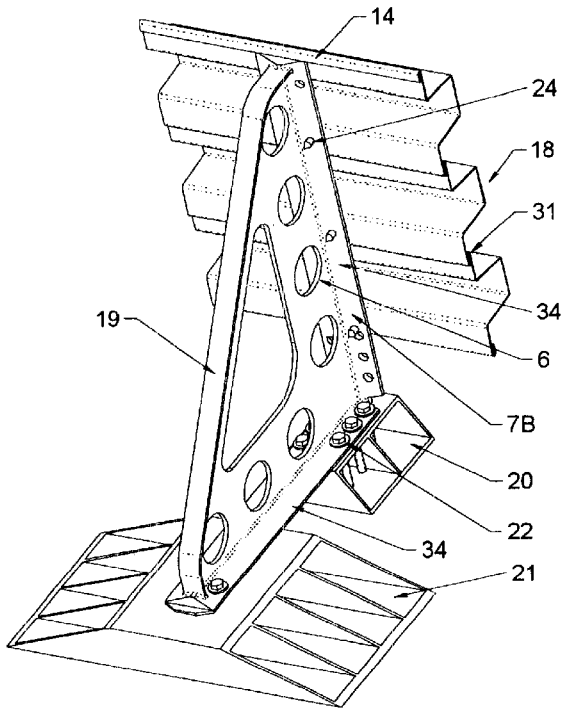
FIG. 5 is a perspective view of the bracket of FIG. 3 with a higher, corrugated fence, mounted on pads.
Figure 6:
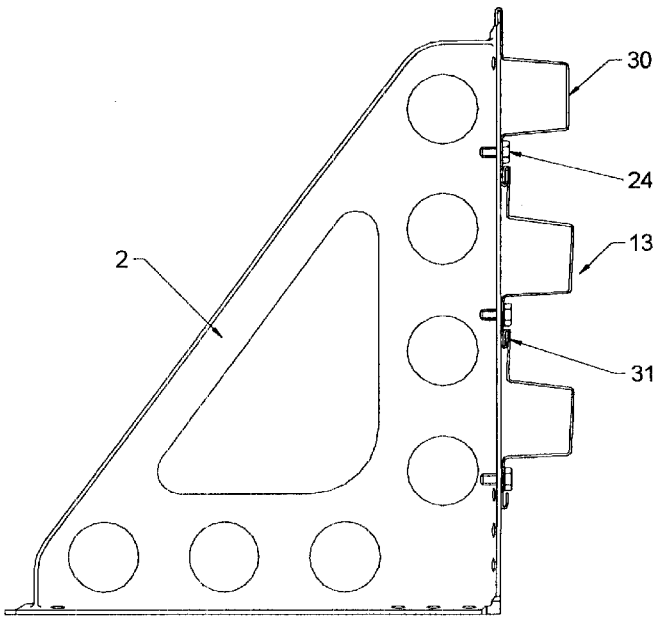
FIG. 6 is a side view of the bracket of FIG. 5.

In FIGS. 5 and 6 a fence 18 with three corrugations is shown. These corrugations may be part of a single sheet, or may be composite, being built up from modular corrugated strips, as shown. In this case, the bracket 2 sits on two pads 20, 21 that spread the load on the roof 1. These pads 20, 21 serve as bracket support means, as do the tracks 4. They are, however, optional, as the brackets 2A, 2B in the non-rail embodiments may be fastened directly to a roof 1. The larger, down-slope pad 21, if employed, need not necessarily be fastened to the roof, but this is preferred. Bolts or threaded screws 22 through the upper pad 20 attach that pad 20 to the roof.

Figure 7:
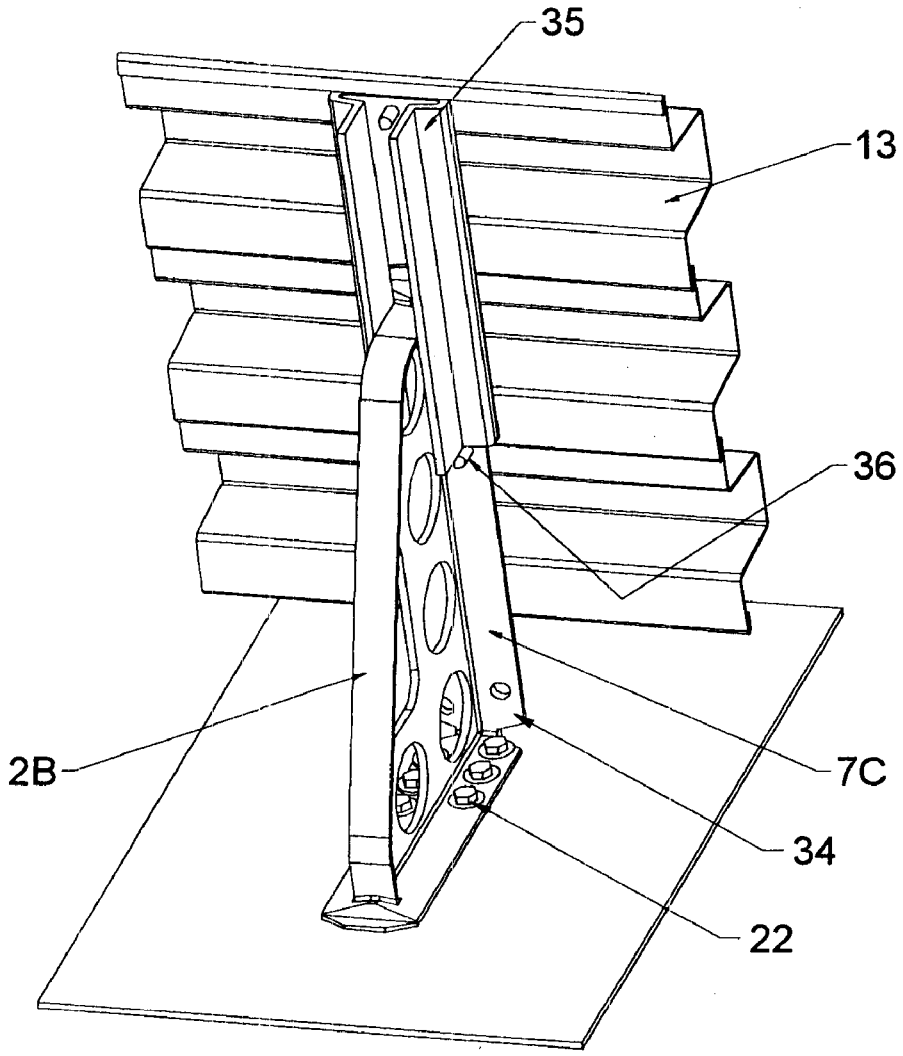
FIG. 7 shows an alternate bracket arrangement with an extension fitted to the upright leg to support a taller fence.

As an alternative to employing a bracket 2 with an upright leg 7B of the full height of the fence 13, as shown in FIG. 5, a smaller bracket 2B as shown in FIG. 7, may be fitted with an extension element 35. This extension 35 may be grooved to fit over the upstanding flanges 34 on the upright leg 7C of the bracket 2B. This extension 35, which preferably is slidingly fitted over the flange 34, is fastened in place by fasteners, such as self-tapping screws 24. As an alternate fastening means, the upright leg 7C of the bracket 2 may be formed with a thickened section 36 that serves as a stop when the extension 35 is slid-down the flange 34.

With the extension 35 seated in place, the rail 13 can be fastened tot he upright leg 7C of the bracket 2B and to the extension 35 portion in the normal manner.

Accordingly, a versatile roof barrier system can be provided with modular parts that can serve multiple purposes.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. A snow barrier for mounting on a roof comprising:

(1) plurality of slotted longitudinally extending tracks provided with means to fasten each such track to an upwardly sloping roof;

(2) a plurality of support brackets each with two legs, both of said legs having a flanged edge with flanges that will slidably engage with a track, said flange being dimensioned to fit within said slot;

(3) each of said brackets providing an upright leg when the other, slot-engaging leg is engaged with said track;

(4) each leg being of a differing length to provide the alternative of assembling the snow barrier with an upright leg of differing lengths for carrying a fence at differing heights;

(5) fastening means for fixing the position of each bracket at an adjustable position within a slot; and (6) a fence for installation on the support brackets whereby, with the tracks mounted to the surface of a sloping roof each associated bracket may be slid to an aligned position, each along a respective track with one of its flanged edges engaged in the slot on the associated track, to be fastened in position on the tracks to receive the fence in an aligned orientation spanning between the brackets.

2. A snow barrier as in claim 1, wherein the fence comprises tubular rails and the brackets are perforated behind both legs to receive and support the tubular rails.

3. A snow barrier as in claim 1, wherein the fence comprises corrugated sheet metal that is fastened to the up-slope side of the upright leg of each bracket.

4. A snow barrier as in claim 3, wherein the upright leg has a to end and the top edge of the corrugated sheet metal forming the fence is shaped to provide a hooked flange that will engage and hook-over the top end of the upright leg of said bracket.

5. A snow barrier as in claim 4, wherein the upright leg has a top end and the top edge of the corrugated sheet metal forming the fence is shaped to provide a hooked flange that will engage and hook-over the top end of the upright leg of said bracket.

6. A snow barrier as in claim 4, wherein the fence comprises multiple, modular corrugated sheet metal portions of a given height and wherein the difference in length between the respective legs of the brackets exceeds the height of a single corrugated sheet metal portion.

7. A snow barrier as in claim 1, wherein the tracks are dimensioned to extend up-slope along the roof, above the line of the fence to be anchored to the roof at a spaced separation from and above the fence.

8. A snow barrier as in claim 5 wherein the fence comprises multiple, individual, sheet metal strips, each with corrugated cross-sections that contain hooked flanges along each of their respective longitudinal edges for interfitting to provide the fence.

9. A snow barrier as in claim 2 wherein the tracks are dimensioned to extend up-slope along the roof, above or below the line of the fence to be anchored to the roof at a spaced separation from and above the fence.

10. A snow barrier as in claim 4 wherein the tracks are dimensioned to extend up-slope along the roof, above or below the line of the fence to be anchored to the roof at a spaced separation from the fence.

11. A snow barrier for roof mounting comprising:

(1) support brackets, each having two flanged legs of differing lengths;

(2) bracket support means for mounting to the surface of a roof and for supporting said brackets by either one of said flanged legs to present the other leg as an upright leg; and (3) a fence for mounting on and spanning between the brackets whereby said legs may provide support for alternate fences of differing heights when installed with their respective bracket support means along a roof.

12. A snow barrier as in claim 11, wherein said upright legs each have a top end and wherein the top edge of the corrugated fence is shaped to provide a hooked flange that will engage and hook-over the top end of each of said brackets.

13. A snow barrier as in claim 9 wherein the fence comprises multiple, individual, sheet metal strips, each with corrugated cross-sections that contain hooked flanges along each of their respective edges for interfitting to provide the fence.

14. A snow barrier as in claim 12 wherein the fence comprises multiple, individual, sheet metal strips, each with corrugated cross-sections that contain hooked flanges along each of their respective edges for interfitting to provide the fence.

* * * * *